United States Patent [19]

Baldridge

[11] 4,311,414

[45] Jan. 19, 1982

[54] PILE WIPER SEAL

[75] Inventor: Morris G. Baldridge, Duncan, Okla.

[73] Assignee: Halliburton Company, Duncan, Okla.

[21] Appl. No.: 126,061

[22] Filed: Feb. 29, 1980

[51] Int. Cl.[3] ..... E02D 5/52

[52] U.S. Cl. ..... 405/227; 405/224

[58] Field of Search ..... 405/224–227, 405/195, 203, 204, 228; 277/88, 235 R; 138/89; 285/229, DIG. 2

[56] References Cited

U.S. PATENT DOCUMENTS

| | | | |
|---|---|---|---|
| 3,533,241 | 10/1970 | Bowerman et al. | 138/89 |
| 3,570,259 | 3/1971 | Thaxton | 405/225 |
| 4,178,112 | 12/1979 | Knox | 405/227 |
| 4,181,454 | 1/1980 | Knox et al. | 405/227 |
| 4,183,698 | 1/1980 | Coone | 405/227 |
| 4,230,424 | 10/1980 | Sullaway | 405/227 |

*Primary Examiner*—Dennis L. Taylor

*Attorney, Agent, or Firm*—John H. Tregoning; James R. Duzan

[57] ABSTRACT

A pile wiper assembly for use on the jacket leg or pile sleeve of a marine platform comprising a pile wiper member and pair of annular plates for retaining the same on the jacket leg or pile sleeve, the pile wiper member comprising an elastomeric member having first reinforcing means throughout, second reinforcing means extending from the peripheral portion into the sealing portion terminating at substantially the diameter of the pile inserted therethrough and, if desired, third reinforcing means extending from the peripheral portion into the sealing portion terminating intermediate the diameter of the pile inserted therethrough and the internal diameter of the annular flat plates.

14 Claims, 5 Drawing Figures

PILE WIPER SEAL

BACKGROUND OF INVENTION

This invention relates to an improved annular wiper seal which is used to prevent the ingress of foreign material from the sea floor into a jacket leg or pile sleeve of a marine platform when driving a piling therethrough.

To secure a marine platform to the sea floor, a pile is usually driven through each of the jacket legs into the sea floor with the top of the piling being secured to the top of the jacket leg by welding shim plates in the annulus between the jacket leg and pile. If the marine platform also has pile sleeves, a pile is driven through each pile sleeve into the sea floor. To secure each pile to the pile sleeves of a marine structure and to provide additional support between each pile driven through a jacket leg of a marine structure, the annulus between the pile and the pile sleeve or jacket leg is filed with grouting material.

When a platform is lowered to the sea floor, the jacket legs or pile sleeves will settle into the sea floor with debris from the sea floor being prevented from entering the jacket legs or pile sleeves by means of diaphragms installed on the bottom thereof. Subsequently, upon driving a pile through the jacket leg or pile sleeve when the diaphragm is ruptured, unless prevented, the inrush of debris from the sea floor and mud entrained in water will fill the annulus through the ruptured diaphragm. If the annulus between the pile and jacket leg or pile sleeve is filled with debris and mud, it is desirable to clean the annulus before the grouting thereof to ensure filling of the annulus with grouting material and the proper bonding of the grouting material to the pile and jacket leg.

In many instances, an annular wiper seal is installed above the diaphragm to seal the annulus between the pile and jacket leg or pile sleeve to prevent the debris and mud from the sea floor rushing into the annulus when the diaphragm is ruptured by the pile being driven therethrough. When the annulus between the pile and jacket leg or pile sleeve is being filled with grouting material, the annular grout seal may also help support the grout column.

One typical type prior art annular wiper seal as described in U.S. Pat. No. 3,533,241 comprises an elastomeric wiper which is reinforced by means of layers of flexible, parallel, reinforcing cords in acute angular relation to the reinforcing cords of adjacent layers, each layer extending from a point intermediate its inner periphery and outer periphery to its outer periphery being alternately wrapped about an annular reinforcing member having a circular cross-sectional shape retained within the outer periphery of the wiper. The wiper is secured to the jacket leg or pile sleeve by means of a pair of annular flat plates which protrude from the jacket leg or pile sleeve, each plate having a semicircular groove therein to receive a portion of the outer periphery of the wiper having the circular cross-sectionally shaped reinforcing member therein. The top annular flat plate of the pair of annular flat plates is secured to the jacket leg or pile sleeve by means of welding with the pair of annular flat plates being secured to each other by a plurality of threaded fasteners extending through apertures in the outer periphery of the pair of annular flat plates.

While this typical prior art seal is generally reliable in service, it requires careful wrapping of the layers of reinforcing cords about the annular circular cross-sectionally shaped reinforcing member during the wiper construction process, requires the machining of semicircular shaped grooves in the flat annular plates to receive the outer periphery of the wiper therein and requires careful torquing of the threaded fasteners to prevent the wiper from being released from the annular flat plates when a pile is inserted and driven therethrough.

Another typical prior art annular wiper seal as described in U.S. Pat. No. 3,570,259 comprises a plurality of wire reinforcing members embedded in elastomeric material. The wiper is held in position in the jacket leg or pile sleeve by means of two annular bands which are welded in position and have an annular channel therein which receives the bent ends of the wire reinforcing members embedded in the elastomeric material. A separate pile guide member is welded in the jacket leg or pile sleeve above the wiper to guide the pile therethrough upon insertion.

While of relatively simple construction, the wiper requires the handling and accurate placement of a large number of wire reinforcing members during the wiper construction process. The wiper additionally requires the use of a separate pile guide member to prevent the pile from damaging the wiper or its securing means when a pile is being inserted therethrough, thereby requiring an extra welding operation to be performed during installation. Furthermore, once the pile has been inserted through the wiper and the reinforcing members plastically deformed, which occurs when the pile is not concentrically located within the wiper or when the pile is withdrawn from the wiper and reinserted therethrough, the wiper is no longer capable of sealingly engaging the periphery of the pile to prevent debris and mud from entering the annulus between the pile and/or the jacket leg or pile sleeve when the diaphragm is ruptured.

Yet another annular pile wiper as described in U.S. Pat. No. 4,181,454 comprises an elastomeric member having a reinforced peripheral portion which is perpendicular to the sealing portion of the wiper, the wiper being retained within the jacket leg or pile sleeve by upper and lower end shoes engaging the reinforced peripheral portion of the wiper and being welded to the interior of the jacket leg or pile sleeve.

While the wiper is simple to construct, its manufacture may involve costly molding dies.

Still yet another annular wiper seal as described in U.S. Pat. No. 4,183,698 comprises a portion of a combination diaphragm, grouting seal and wiper assembly installed on the lower end of a jacket leg of an offshore platform. The annular wiper seal comprises an elastomeric manifold which acts as a grout seal and a pile wiper. The manifold is initially retained within a housing by a shiftable cage having shoulders thereon which protrude into the jacket leg of the platform. As a pile is driven through the jacket leg, the pile engages the shoulders on the cage causing the cage to be driven through the diaphragm on the jacket leg with the diaphragm being severed by the cage and the end of the pile. When the cage has been shifted downwardly, the manifold expands into engagement with the pile thereby acting as a pile wiper during pile driving operations and grout manifold for subsequent grouting operations. In an alternative embodiment of the combination grout seal and pile wiper, the shiftable cage is eliminated with the reinforced periphery of the diaphragm retaining the manifold in its collapsed state. Upon inserting and driving a pile through the jacket leg, the pile shifts the diaphragm to allow the manifold to expand with the end of the pile severing the diaphragm.

While the combination of a grout seal and pile wiper may offer advantages over a separate pile wiper assembly and grout seal assembly installed on the jacket leg of an offshore platform, the combination grout seal and pile wiper may be damaged during pile insertion and driving operations and fail to perform either as a pile wiper or grout seal.

SUMMARY OF INVENTION

In contrast to the prior art annular wiper seals, the present invention comprises an elastomeric member having multiple stages of reinforcement means throughout and having positive anchoring means engaging the outer periphery of the annular wiper seal to retain the seal in the lower end of a jacket leg or pile sleeve of a marine structure.

The foregoing invention will be appreciated and understood from the following specification and drawings wherein:

DESCRIPTION OF PREFERRED EMBODIMENTS

Figure 1:
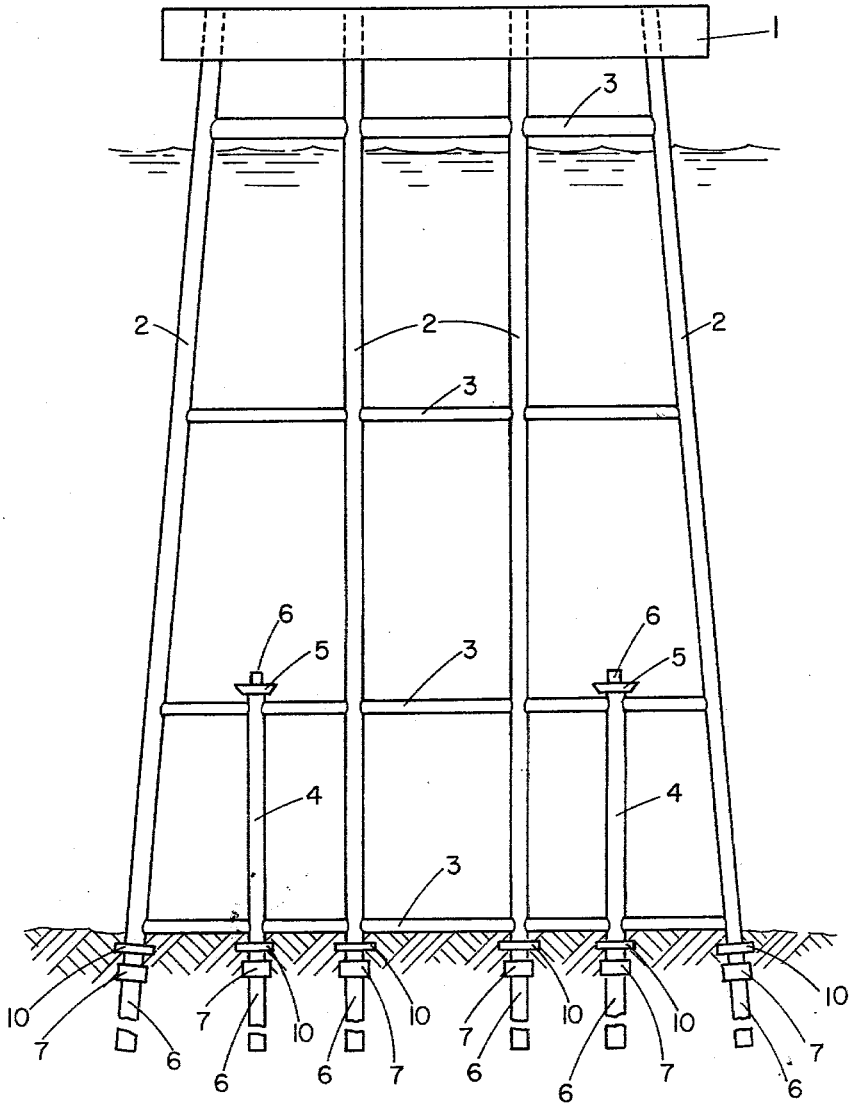
FIG. 1 is a side elevational view of a marine platform having jacket legs and pile sleeves between the jacket legs, the marine platform resting on the bottom of a body of water.

Referring to FIG. 1, a marine platform 1 having tubular supporting legs 2 between which horizontal reinforcing members 3 are connected is shown. Tubular piling guides or pile sleeves 4, which may have flared upper ends 5, are supported between the lower end portion of the legs 2 by the lower reinforcing members 3 and, as the legs, are adapted to rest upon or have their lower extremities slightly embedded in the bottom of a body of water.

The marine platform is anchored or secured in position by driving piles 6 through the legs 2 or guides 4 into the bottom of the body of water. Upon completion of the pile driving, the piles 6 are welded to the tops of the legs 2 and the annulus between each leg 2 and guide 4 and its associated pile 6 is filled with grout to provide a unitary base structure by securing the guide 4 to its associated pile 6 and providing a uniform load bearing structure with respect to the leg 2 and its associated pile 6.

Contained on the bottom of each leg 2 and guide sleeve 4 is a wiper assembly 10 and rupturable seal assembly 7.

Figure 2:
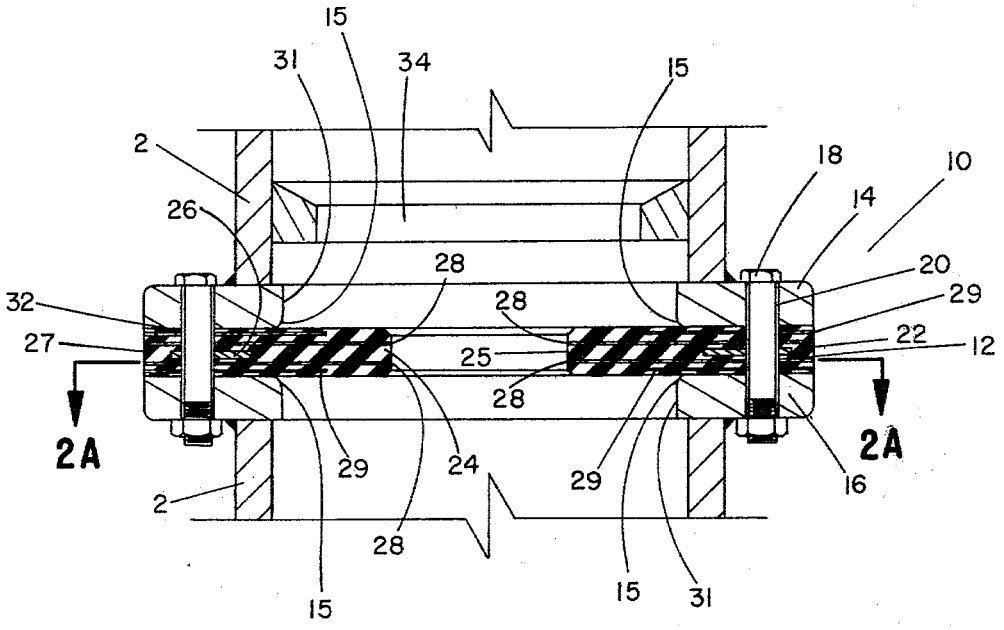
FIG. 2 is a cross-sectional view of a first embodiment of the present invention.

Referring to FIG. 2, a first embodiment of the present invention is shown. The wiper assembly 10 comprises an elastomeric wiper member 12 retained between an upper annular plate 14 and lower annular plate 16, the annular plates 14 and 16 having inner radiused edges 15 thereon. The upper annular plate 14 is secured to the lower annular plate 16 by means of a plurality of threaded fastening members 18 extending through apertures 20 in the plates 14 and 16. As shown, the wiper assembly 10 is installed in a jacket leg 2 of a marine platform being secured thereto by any suitable means, such as welding.

The elastomeric wiper member 12 comprises an elastomeric member having a peripheral portion 22 which is contained between the upper 14 and lower 16 annular plates, having a sealing portion 24 which has a central aperture 25 therein, having an annular reinforcing member 26 located in the peripheral portion 22 which has a generally rectangular cross-sectional shape, having first annular reinforcing means 28 which extend from the central aperture 25 in the sealing portion 24 through the peripheral portion 24 to the outer circumferential edge 27 thereof, and having second annular reinforcing means 29 which extend in the sealing portion 24 from the diameter of the pile which is to be driven through the wiper assembly 10 through the peripheral portion 22 to the outer circumferential edge 27 thereof. The elastomeric wiper member 12 also contains a plurality of apertures 32 in the peripheral portion 22 which extend through the annular reinforcing member 26, the first annular reinforcing means 28, and second annular reinforcing means 29 and which receive the threaded fastening means 18 therein when the wiper member 12 is installed between the upper 14 and lower 26 annular plates secured to the jacket leg 2.

The annular reinforcing member 26 provides sufficient reinforcement in the peripheral portion of the annular wiper member 12 to prevent the wiper member 12 from readily tearing or being pulled from between the upper 14 and lower 16 annular plates upon the insertion and driving a pile therethrough. Any desired thickness or number of annular reinforcing members 26 may be utilized in the peripheral portion 22 of the annular wiper member 12 depending upon the expected piling loads to be exerted upon the wiper member 12. The annular reinforcing member 26 may be fabricated from any suitable metal, such as steel.

The first annular reinforcing means 28 may be of any suitable fabric, although nylon is preferred. The first annular reinforcing means 28 comprises a plurality of layers of woven fabric, at least one layer of fabric being positioned on either side of the annular reinforcing member 26, which are positioned in the annular wiper member 12 such that a thin layer of elastomeric material is present between the annular reinforcing member 26 and the first annular reinforcing means 28.

The second annular reinforcing means 29 may also be of any suitable fabric, although nylon is preferred. The second annular reinforcing means 29 comprises a plurality of layers of woven fabric, at least one layer of fabric being positioned on either side of the first annular reinforcing means 28 which are secured to the annular reinforcing member 26 and being secured to the first annular reinforcing means 28. The additional reinforcement of the annular reinforcing means 29 in the area of the inner radiused edges 15 of the annular flat plates 14 and 16 helps to prevent severing and tearing of the first and second annular reinforcing means 28 and 29 respectively in the area of the inner radiused edges 15 upon the insertion and driving of a pile through the wiper assembly 10. The additional reinforcement of the second annular reinforcing means 29 extending from the peripheral portion 22 into the sealing portion 24 and terminating therein at the diameter of the pile to be inserted through the wiper member 12 also provides additional stiffness and deflection resistance to the wiper member 12.

It should be noted that the more layers of fabric in the first and second annular reinforcing means 28 and 29 respectively, the stiffer and more resistant to deflection the elastomeric wiper member 12 will be, thereby allowing the elastomeric wiper member 12 to withstand a greater fluid pressure differential thereacross without incurring fluid leakage around a pile inserted therethrough. It should be further noted that upon the insertion of a pile through the elastomeric wiper member 12 and the sealing portion 24 of the member 12, the sealing portion 24 will be stretched due to the interference between the pile and the sealing portion 24 with the possible tearing of some of the warps and wefts of the woven fabric depending upon the elasticity or elongation characteristics of the woven fabric.

It should also be noted that it is desirable to have a high degree of interference between the sealing portion 24 of the wiper member 12 and the pile being inserted and driven therethrough since the more interference between the pile and sealing portion 24 of the wiper member 12, i.e., the tighter the sealing portion engages the pile, the wiper member 12 has the ability to withstand a greater fluid pressure differential thereacross without incurring fluid leakage around a piling inserted therethrough. Further, since most common woven fabrics generally exhibit a lesser degree of elasticity or elongation than common elastomeric materials, the amount of interference between the pile and sealing portion 24 of the wiper member 12 is limited by the amount of tearing of the warps and wefts of the woven fabric used to reinforce the wiper member 12.

In the wiper member 12 of the present invention the first 28 and second 29 annular reinforcing means, while comprising layers of woven fabric, are formed of a plurality of arcuate shaped pieces of woven fabric rather than being formed from a unitary piece of woven fabric. The arcuate shaped pieces of woven fabric are secured to each other in an overlapping relationship about the common edges of their periphery having a thin layer of elastomeric material therebetween. In this manner, the amount of interference between the sealing portion 24 of the wiper member 12 and the pile being inserted therethrough may be increased without the tearing of the warps and wefts of the woven fabric in the arcuate pieces over the amount of interference between the sealing portion of a wiper member having unitary layers of woven fabric for reinforcement since the thin layer of elastomeric material allows relative movement between adjacent arcuate shaped pieces of woven fabric.

By utilizing arcuate shaped pieces of woven fabric having the common edges of their periphery overlapping and being secured to each other to form the first 28 and second 29 annular reinforcing means, the first 28 and second 29 annular reinforcing means may also be more economically constructed than having a unitary piece of woven fabric therefor since the arcuate shaped pieces of woven fabric may be cut from small pieces of woven fabric. This is particularly important when the pile wiper member 12 may be for use with a pile having a diameter of seventy-two (72) inches or more.

It should be understood that although it is preferable to utilize overlapping arcuate shaped pieces of woven fabric to form the first 28 and second 29 annular reinforcing means, since the second annular reinforcing means 29 extends from the peripheral portion 22 into the sealing portion 24 and terminates therein at the diameter of the pile to be inserted through the wiper member 12, the second annular reinforcing means 29 may alternately be formed of unitary pieces of woven fabric.

It should be noted that although it is desired to form the wiper member 12 having a high degree of stiffness, thereby having an increased ability to withstand fluid pressure differentials thereacross without leaking, the wiper member 12 must also remain flexible to be capable of sealing the annulus between the jacket leg or pile sleeve and the piling during both upward and downward movement of the piling therethrough. Unless the piling is physically lifted upward after the insertion thereof through the wiper member 12, upward movement of the piling through the wiper member 12 generally occurs when driving the pile into the sea floor. After each hammer blow on the pile, due to the natural resiliency of the pile and the geological formations into which the pile is driven, the pile springs or bounces upwardly requiring the sealing portion 24 of the wiper member 12 to flex upwardly while maintaining sealing engagement with the pile being driven therethrough. By utilizing arcuate shaped pieces of woven fabric having the common edges of their periphery overlapping and being secured to each other to form the second reinforcing means 29, the wiper member 12 will retain a greater degree of flexibility than if the second reinforcing means 29 are formed of unitary pieces of woven fabric.

The annular wiper member 12 may be formed of any suitable elastomeric material, such as rubber, synthetic rubber, etc.

To assist in guiding the piling through the wiper assembly 10 to help prevent damage to the annular wiper member 12, a pile guide ring 34 may be installed in the jacket leg or pile sleeve at any convenient location therein.

Figure 2A:
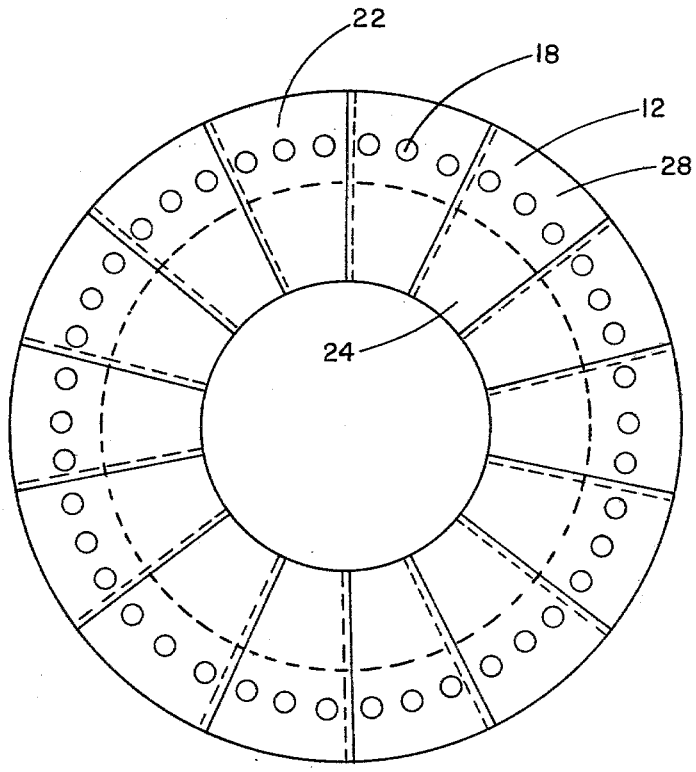
FIG. 2A is a cross-sectional view along line 2A—2A of FIG. 2 illustrating the first reinforcing means of the present invention.

Referring briefly to FIG. 2A, the plurality of arcuate shaped pieces of woven fabric, having the common edges of their periphery overlapping and being secured to each other, that form each layer of the first reinforcing means 28 is shown. Although the arcuated shaped pieces of woven fabric are shown having one common peripheral edge overlaying the common peripheral edge of an adjacent arcuate shaped piece while the other common peripheral edge underlays the common peripheral edge of another adjacent arcuated shaped piece, the arcuate shaped pieces may be arranged in any manner to form each layer of the first reinforcing means 28 so long as the common peripheral edges of the arcuated shaped pieces are secured to each other by a layer of elastomeric material.

Also, although only a layer of the first reinforcing means 28 has been shown in FIG. 2A, the second reinforcing means 29 may be similarly constructed.

Figure 3:
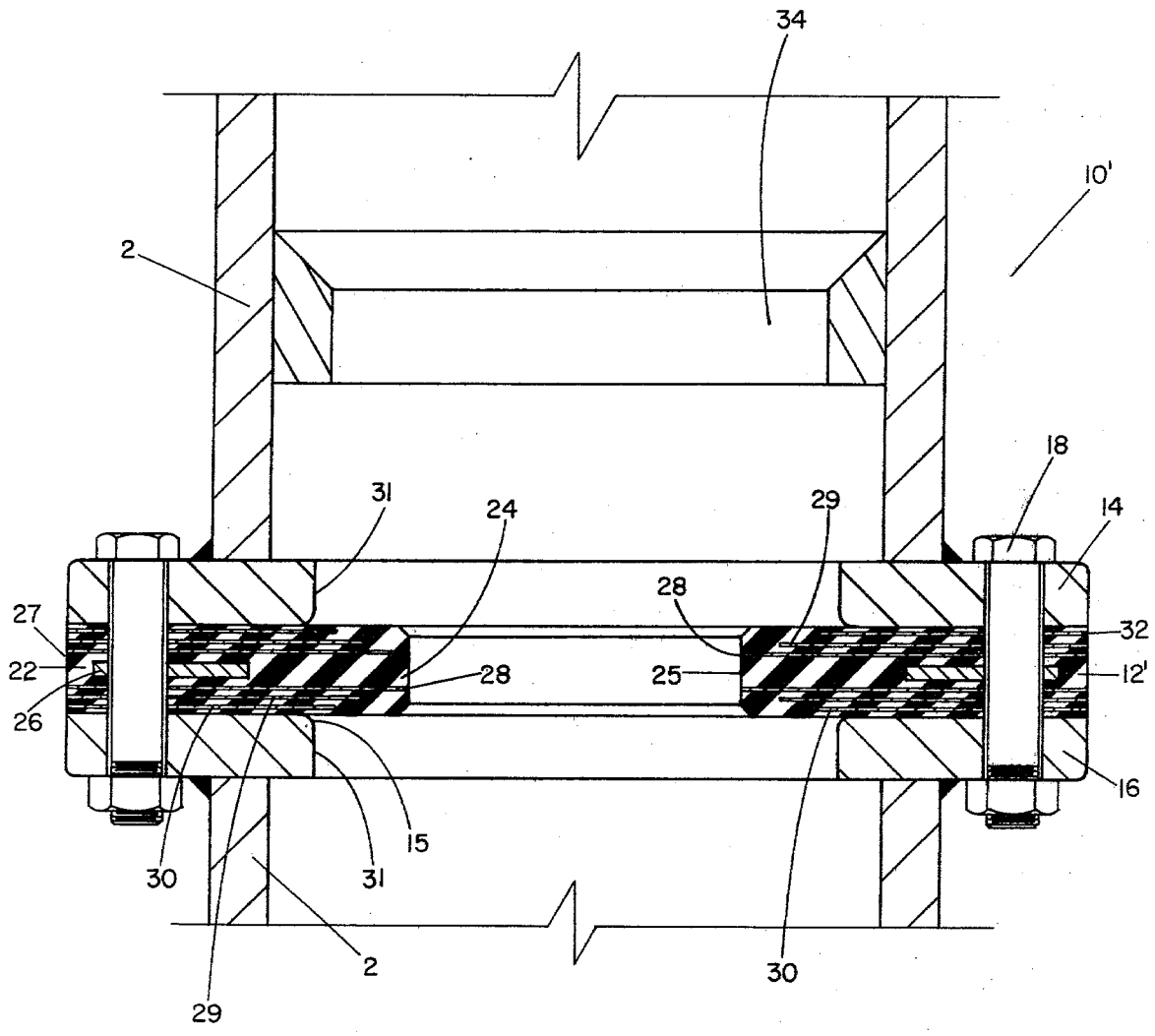
FIG. 3 is a cross-sectional view of a second embodiment of the present invention.

Referring to FIG. 3, a second embodiment of the present invention is shown. The wiper assembly 10' comprises an elastomeric wiper member 12' retained between an upper annular plate 12 and lower annular plate 16. The wiper assembly 10' is identical to the wiper assembly 10 described hereinbefore except for the construction of the elastomeric wiper member 12'.

The elastomeric wiper member 12' comprises an elastomeric member having a peripheral portion 22 which is contained between the upper 14 and lower 16 annular plates, having a sealing portion 24 which has a central aperture 25 therein, having an annular reinforcing member 26 located in the peripheral portion 22 which has a generally rectangular cross-sectional shape, having first annular reinforcing means 28 which extend from the central aperture 25 in the sealing portion 24 through the peripheral portion 24 to the outer circumferential edge thereof, having second annular reinforcing means 29 which extend in the sealing portion 24 from the diameter of the pile to be driven through the wiper assembly 10' through the peripheral portion 22 to the outer circumferential edge 27 thereof, and having third annular reinforcing means 30 which extend in the sealing portion 24 from a point intermediate the inner diameter of the second reinforcing means 29 and the inner diameter 31 of the upper 14 and lower 16 annular plates through the peripheral portion 22 to the outer circumferential edge 27 thereof. The elastomeric wiper member 12' also contains a plurality of apertures 32 in the peripheral portion 22 which extend through the annular reinforcing member 26, through the first 28, the second 29 and the third 30 annular reinforcing means, and which receive threaded fastening means 18 therein when the wiper member 12 is installed between the upper 14 and lower 16 annular plates secured to the jacket leg 2.

The annular reinforcing means 26 is identical to the annular reinforcing means 26 described hereinbefore in FIG. 2.

The first 28 and second 29 annular reinforcing means are identical to the first 28 and second 29 annular reinforcing means described hereinbefore in FIG. 2.

The third 30 annular reinforcing means comprise a plurality of layers of woven fabric, at least one layer of fabric being positioned on either side of the annular reinforcing member 26 overlaying the adjacent layers of the second 29 annular reinforcing means. By placing a third 30 annular reinforcing means in the elastomeric wiper member 12' in the area of the inner radiused edges 15 of the annular flat plates 14 and 16, this helps to prevent severing or tearing of the first 28 and second 29 annular reinforcing means while adding stiffness to the wiper member 12' and at the same time allowing the member 12' to have a degree of flexibility in the sealing portion to allow the member 12' to flex in any direction during the insertion, removal and driving of a pile therethrough.

The third 30 annular reinforcing means, while comprising layers of woven fabric, are formed of a plurality of arcuate shaped pieces of woven fabric rather than being formed from a unitary piece of woven fabric. The arcuate shaped pieces of woven fabric are secured to each other in an overlapping relationship about the common edges of their periphery having a thin layer of elastomeric material therebetween. Although it is preferable to utilize overlapping arcuate shaped pieces of woven fabric to form the third 30 annular reinforcing means, since the third 30 annular reinforcing means extends from the peripheral portion 22 into the sealing portion 24 and terminates therein intermediate the diameter of the pile to be inserted through the wiper member 12' and the inner diameter 31 of the annular plates 14 and 16, the third 30 annular reinforcing means may alternately be formed of unitary pieces of woven fabric.

Figure 4:
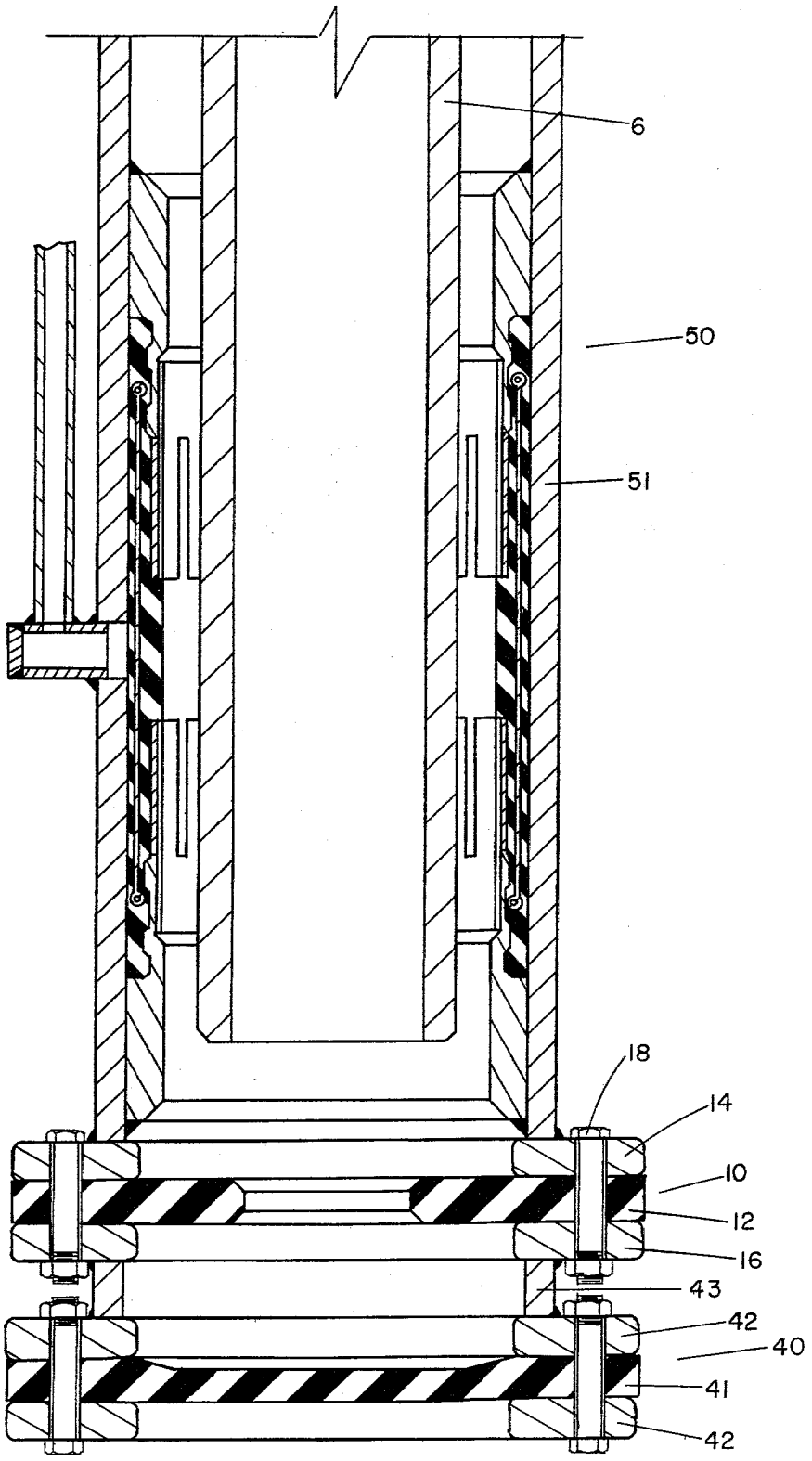
FIG. 4 is a cross-sectional view of the present invention installed in a jacket leg or pile sleeve of a marine structure in conjunction with an inflatable packer and diaphragm.

Referring to FIG. 4, the wiper assembly 10 is shown in conjunction with an inflatable packer assembly 50 and diaphragm assembly 40. The wiper assembly 10 is shown installed on the end of an extended case 51 which is, in turn, secured to the lower end of a jacket leg 2 or pile sleeve 4 (not shown). The diaphragm assembly 40 comprises a pair of flanges 42, the upper flange being secured to a transition piece 43 which extends from the lower annular plate 16 of the wiper assembly 10, and diaphragm member 41 being retained in sealing engagement between the flanges 42 by means of a plurality of threaded fastening means 43.

As shown, when the pile 6 is inserted through the annular wiper member 12, the wiper member 12 will seal the annulus between the pile 6 and the extended case 51 of the inflatable packer 30, thereby preventing the entry of debris and mud entrained in water after the diaphragm member 41 has been ruptured by driving the pile 6 therethrough.

It should be noted that although the sealing portions 24 of the wiper member 12 and 12' have been shown in FIGS. 2 through 4 of the drawings as extending perpendicularly or at substantially a right angle from the jacket leg or pile sleeve of a marine platform, the sealing portions 24 may be formed at an acute angle with respect to the jacket leg or pile sleeve, thereby formed a conically shaped sealing portion to assist in inserting a pile therethrough.

From the foregoing, it can be easily seen that the present invention offers the advantages of:

Simplicity of annular wiper member construction;

Simplicity of annular plate construction requiring little machining thereof;

Simplicity of attachment to a jacket leg or pile sleeve of a marine platform;

Increased sealing with the inserted pile while maintaining a high degree of wiper member flexibility; and Adaptability for use with an inflatable packer and/or diaphragm installed on the jacket leg or pile sleeve of a marine platform.

Having thus described my invention, I claim:

1. A pile wiper seal assembly sealing the annulus between either a tubular jacket leg or tubular pile sleeve and a pile inserted therethrough of a marine platform, said pile wiper seal assembly comprising:

annular wiper member means having a peripheral portion and a sealing portion extending inwardly therefrom, said annular wiper member means comprising:

elastomeric member means;

annular reinforcing member means having a generally rectangular cross-sectional shape located in the peripheral portion of said annular wiper member means; and annular reinforcing means located in said annular wiper member means and being secured to the annular reinforcing member means in the peripheral portion of said annular wiper member means, the annular reinforcing means comprising:

first annular reinforcing means extending throughout the peripheral portion and sealing portion of said annular wiper member means, the first annular reinforcing means being secured to the annular reinforcing member means located in the peripheral portion of said annular wiper means; and second annular reinforcing means extending throughout the peripheral portion of said annular wiper member means into the sealing portion of said annular wiper member means and terminating therein at a diameter substantially equal to the external diameter of said pile inserted through said pile wiper seal assembly; and annular wiper member retaining means comprising:

a pair of annular plate means, each annular plate means of the pair being secured to the other by a plurality of fastening means extending through the elastomeric member means, the annular reinforcing member means and the annular reinforcing means of said annular wiper member means, said annular wiper member retaining means having at least one of the pair of annular plate means secured to either said tubular jacket leg or said tubular pile sleeve of said marine platform.

2. The pile wiper seal assembly of claim 1 wherein:

the first annular reinforcing means comprise a plurality of annular reinforcing means located on either side of the annular reinforcing member means; and the second annular reinforcing means comprise a plurality of annular reinforcing means located on either side of the annular reinforcing member means.

3. The pile wiper seal assembly of claim 2 wherein:

at least one annular reinforcing means of the plurality of first annular reinforcing means is located on each side of the annular reinforcing member means; and at least one annular reinforcing means of the plurality of second annular reinforcing means is located on each side of the annular reinforcing member means.

4. The pile wiper seal assembly of claim 1 wherein:

the first annular reinforcing means comprise a plurality of layers of fabric; and the second annular reinforcing means comprise a plurality of layers of fabric.

5. The pile wiper seal assembly of claim 4 wherein:

each layer of the plurality of layers of fabric of the first annular reinforcing means comprises a plurality of arcuate shaped segments of fabric having their common peripheral edges overlapping and secured to each other by a layer of elastomeric material; and each layer of the plurality of layers of fabric of the second annular reinforcing means comprises a plurality of arcuate shaped segments of fabric having their common peripheral edges overlapping and secured to each other by a layer of elastomeric material.

6. The pile wiper seal assembly of claim 4 wherein:

each layer of the plurality of layers of fabric of the first annular reinforcing means comprises a plurality of arcuate shaped segments of fabric having their common peripheral edges overlapping and secured to each other by a layer of elastomeric material.

7. The pile wiper seal assembly of claim 1 wherein the annular reinforcing means of said annular wiper member means further comprises:

third annular reinforcing means extending throughout the peripheral portion of said annular wiper member means into the sealing portion of said annular wiper member means and terminating therein at a diameter intermediate a diameter substantially equal to the external diameter of said pile inserted through said pile wiper seal assembly and the internal diameter of said annular wiper member retaining means.

8. The pile wiper seal assembly of claim 7 wherein:

the third annular reinforcing means comprise a plurality of annular reinforcing means having at least one annular reinforcing means of the plurality located on each side of the annular reinforcing member means.

9. The pile wiper seal assembly of claim 7 wherein:

the third annular reinforcing means comprise a plurality of layers of fabric.

10. The pile wiper seal assembly of claim 9 wherein:

each layer of the plurality of layers of fabric of the third annular reinforcing means comprises a plurality of arcuate shaped segments of fabric having their common peripheral edges overlapping and secured to each other by a layer of elastomeric material.

11. A pile wiper seal assembly sealing the annulus between either a tubular jacket leg or tubular pile sleeve and a pile inserted therethrough of a marine platform, said pile wiper seal assembly comprising:

annular wiper member means having a peripheral portion and a sealing portion extending inwardly therefrom, said annular wiper member means comprising:

elastomeric member means;

annular reinforcing member means having a generally rectangular cross-sectional shape located in the peripheral portion of said annular wiper member means; and annular reinforcing means located in said annular wiper member means and being secured to the annular reinforcing member means in the peripheral portion of said annular wiper member means, the annular reinforcing means comprising:

first annular reinforcing means comprising a plurality of layers of fabric, each layer of the plurality being formed by a plurality of arcuate shaped segments of fabric having their common peripheral edges overlapping and secured to each other by a layer of elastomeric material, extending throughout the peripheral portion and sealing portion of said annular wiper member means, the first annular reinforcing means being secured to the annular reinforcing member means located in the peripheral portion of said annular wiper means; and second annular reinforcing means comprising a plurality of layers of fabric extending throughout the peripheral portion of said annular wiper member means into the sealing portion of said annular wiper member means and terminating therein at a diameter substantially equal to the external diameter of said pile inserted through said pile wiper seal assembly; and annular wiper member retaining means comprising:

a pair of annular plate means, each annular plate means of the pair being secured to the other by a plurality of fastening means, the annular reinforcing member means and the annular reinforcing means of said annular wiper member means, said annular wiper member retaining means having at least one of the pair of annular plate means secured to either said tubular jacket leg or said tubular pile sleeve of said marine platform.

12. A pile wiper seal assembly sealing the annulus between either a tubular jacket leg or tubular pile sleeve and a pile inserted therethrough of a marine platform, said pile wiper seal assembly comprising:

annular wiper member means having a peripheral portion and a sealing portion extending inwardly therefrom, said annular wiper member means comprising:

elastomeric member means;

annular reinforcing member means having a generally rectangular cross-sectional shape located in the peripheral portion of said annular wiper member means; and annular reinforcing means located in said annular wiper member means and being secured to the annular reinforcing member means in the peripheral portion of said annular wiper member means, the annular reinforcing means comprising:

first annular reinforcing means comprising a plurality of layers of fabric, each layer of the plurality being formed by a plurality of arcuate shaped segments of fabric having their common peripheral edges overlapping and secured to each other by a layer of elastomeric material, extending throughout the peripheral portion and sealing portion of said annular wiper member means, the first annular reinforcing means being secured to the annular reinforcing member means located in the peripheral portion of said annular wiper means;

second annular reinforcing means comprising a plurality of layers of fabric extending throughout the peripheral portion of said annular wiper member means into the sealing portion of said annular wiper member means and terminating therein at a diameter substantially equal to the external diameter of said pile inserted through said pile wiper seal assembly; and third annular reinforcing means comprising a plurality of layers of fabric extending throughout the peripheral portion of said annular wiper member means into the sealing portion of said annular wiper member means and terminating therein at a diameter intermediate a diameter substantially equal to the external diameter of said pile inserted through said pile wiper seal assembly and the internal diameter of said annular wiper member retaining means; and annular wiper member retaining means comprising:

a pair of annular plate means, each annular plate means of the pair being secured to the other by a plurality of fastening means, the annular reinforcing member means and the annular reinforcing means of said annular wiper member means, said annular wiper member retaining means having at least one of the pair of annular plate means secured to either said tubular jacket leg or said tubular pile sleeve of said marine platform.

13. The pile wiper seal assembly of claim 12 wherein:

at least one layer of the plurality of layers of fabric of the first annular reinforcing means is located on each side of the annular reinforcing member means being secured thereto;

at least one layer of the plurality of layers of fabric of the second annular reinforcing means is located on each side of the annular reinforcing member means overlaying at least one layer of fabric of the first reinforcing means; and at least one layer of the plurality of layers of fabric of the third annular reinforcing means is located on each side of the annular reinforcing member means overlaying at least one layer of fabric of the second reinforcing means.

14. The pile wiper seal assembly of claim 13 wherein:

each layer of the plurality of layers of fabric of the second reinforcing means comprises a plurality of arcuate shaped segments of fabric having their common peripheral edges overlapping and secured to each other by a layer of elastomeric material; and each layer of the plurality of layers of fabric of the third reinforcing means comprises a plurality of arcuate shaped segments of fabric having their common peripheral edges overlapping and secured to each other by a layer of elastomeric material.

* * * * *

UNITED STATES PATENT AND TRADEMARK OFFICE

CERTIFICATE OF CORRECTION

PATENT NO. : 4,311,414

DATED : January 19, 1982

INVENTOR(S) : Morris G. Baldridge

It is certified that error appears in the above-identified patent and that said Letters Patent are hereby corrected as shown below:

In column 4, line 32, delete the number [26] and insert therefor --16--.

Signed and Sealed this

First Day of June 1982

[SEAL]

*Attest:*

GERALD J. MOSSINGHOFF

*Attesting Officer*

*Commissioner of Patents and Trademarks*